US006129016A

United States Patent [19]

Rehkemper et al.

[11] Patent Number: 6,129,016

[45] Date of Patent: Oct. 10, 2000

[54] STAMPING TOY HAVING INDEXING MEANS

[76] Inventors: Steven Rehkemper, Rehkemper Invention & Design, 1300 W. Washington Blvd., Chicago, Ill. 60607; Jeffery Rehkemper, 1636 N. Wells; Todd J. Hannon, 2022 N. Bissell, both of Chicago, Ill. 60614

[21] Appl. No.: 09/054,807

[22] Filed: Apr. 3, 1998

[51] Int. Cl.[7] ..... B41F 31/00

[52] U.S. Cl. ..... 101/327

[58] Field of Search ..... 101/72, 73, 78, 101/84, 103, 109, 327, 333, 405, 45

[56] References Cited

U.S. PATENT DOCUMENTS 3,783,786 1/1974 Ellison et al. ..... 101/103

4,070,967 1/1978 Schlau et al. ..... 101/333

4,649,819 3/1987 Voto, Jr. et al. ..... 101/327

5,048,414 9/1991 Hoshino ..... 101/78

*Primary Examiner*—Edgar Burr

*Assistant Examiner*—Leslie Grohusky

[57] ABSTRACT

A stamping toy having a pair of self inking stamp pads. The arms are part of a housing assembly including a central drum which is rotatably mounted on a center support post and is biased along with the housing assembly by spring means into an inoperative position. A series of opposed radially spaced depending fingers and upwardly projecting projections are positioned in opposed relationship within the drum. An indexing rod on the post is adapted to cooperate with camming surfaces on the fingers and projections to rotate the arms as the drum is moved from an inoperative to the operative position and back to the inoperative position.

7 Claims, 5 Drawing Sheets

FIG. 6
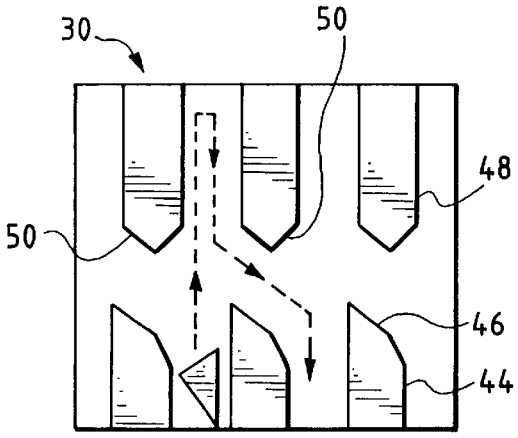
FIG. 5
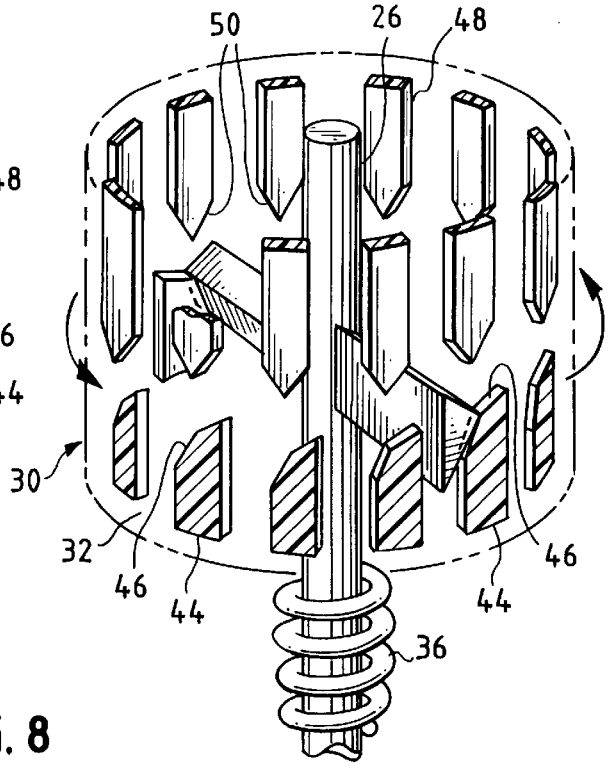
FIG. 7
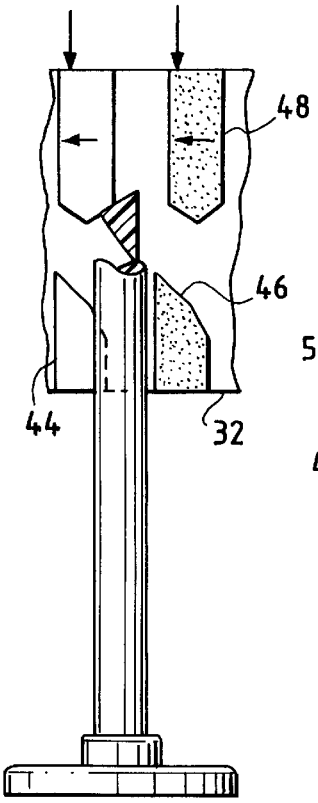
FIG. 8
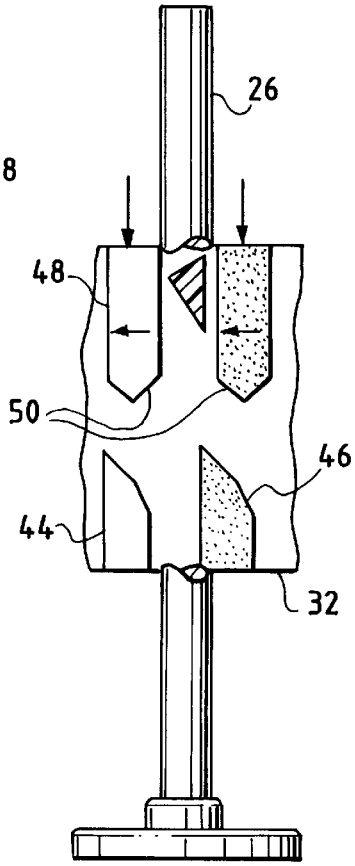
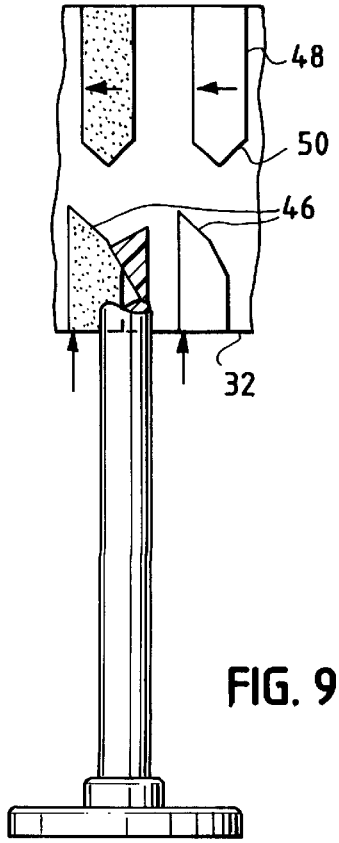
FIG. 9

STAMPING TOY HAVING INDEXING MEANS

BACKGROUND OF THE INVENTION

This invention relates to toys and more particularly to a stamping toy having self-contained, automatic indexing means enabling the creation of varied stamped patterns.

Printing and pattern making are forms of artistic expression that children find fascinating and entertaining. The arrangement of figures in a symmetrical or regularly spaced pattern is difficult to achieve even assuming the knowledgeable use of drafting instruments like rulers, protractors, compasses and the like. For most children the proper use of such instruments is daunting or not feasible.

It would thus be desirable to provide a toy having self-contained indexing means whereby it is automatically enabled to stamp impressions in a regularly spaced and symmetrical pattern.

SUMMARY OF THE INVENTION

Briefly the invention comprises a housing rotatably mounted on a center post. The housing has a pair of oppositely projecting wings or arms, at the ends of which are carried self-inking stamp pads. The stamp pads are provided with removable and interchangeable platen faces so that a variety of impression styles is possible.

The housing is fixedly mounted on a central indexing cylinder or drum which drum is rotatably mounted on the center post. The drum sits on a bias spring normally urging the housing and stamp pads up and above the printing surface. A cylindrical indexing ring is fit into the top the drum and said ring is provided with a plurality of radically spaced indexing fingers. Around the interior wall of the drum there is provided a plurality of radially spaced lower indexing projections in like number and opposed to the upper indexing fingers. The indexing fingers and projections are formed with camming faces and opposed pairs of fingers and projections are in vertically misaligned relationship.

A wedge-shaped indexing rod is fixedly carried on the center post positioned interiorly of the drum, and the rod serves to limit the upward bias of the drum and housing. Downward movement of the housing and compression of the bias spring causes the indexing rod to bear against the camming surfaces of a pair of upper indexing figures resulting in a slight rotation of the drum as the rod rides up into the spaces between the affected pair of fingers. After completion of downward movement of the housing and application of the stamp pad platens to the printing surface, pressure on the housing is released. As the housing is biased upwardly to the neutral position, the indexing rod is caused to bear against a pair of lower indexing projections until it rides down to the bottom wall of the drum and into the spaces between the affected pair of projections. The latter movement results in an indexing rotation of the drum awaiting the next cycle of stamping.

The inventive amusement device is simple to use and, by virtue of its self-contained indexing action enables the user to create symmetrical and regularly spaced patterns. Numerous other features and advantages of the invention will become apparent from the following detailed description of the invention, from the claims and from the accompanying drawings.

BRIEF DESCRIPTION OF THE DRAWINGS

In the accompanying drawings forming a part of the specification, and in which like numerals are employed to designate like parts throughout.

FIG. 5 is an enlarged, perspective with of the drum, with portions of the drum wall removed to show the relationship of the opposed upper fingers and lower indexing projections around the inner wall thereof and cooperation therewith of the indexing rod when the housing is in the inoperative position;

FIG. 6 is a fragmentary developed section of the drum illustrating schematically the path of travel of the indexing rod from inoperative to stamping and back to inoperative position;

FIG. 7 is a similar view showing the indexing rod engaging an upper finger as the housing is depressed;

FIG. 8 is a similar view showing the position of the indexing rod as the stamp pads are printing;

FIG. 9 is a similar view showing the indexing rod engaging a lower projection as the drum is returning to the inoperative position.

DETAILED DESCRIPTION OF THE INVENTION

Figure 1:
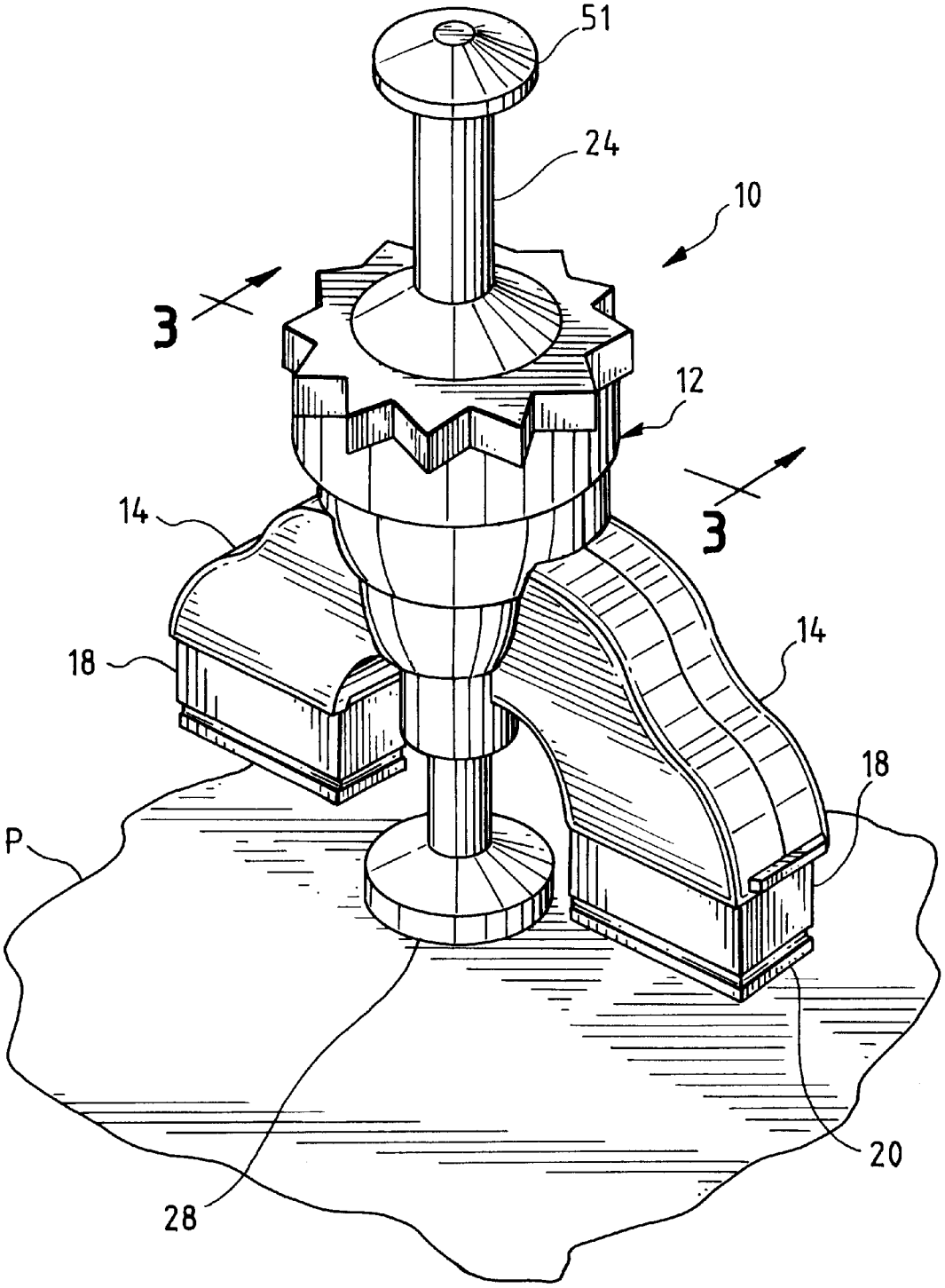
FIG. 1 is a perspective view of a stamping toy embodying the principles of the invention.

Referring with greater particularity to the various figures of the drawing, it will be seen that the reference numeral 10 identifies generally a stamping toy embodying the principles of the invention. Stamping toy 10 comprises a housing 12 having oppositely projecting arms 14, 14. The arms 14 are provided with groove means 16 (FIG. 2) at their downwardly facing ends adapted to releasably retain self-inking stamp pads 18, 18 said stamp pads being adapted to releasably carry interchangeable printing platens 20.

The housing 12 comprises a central cavity 22 having a stem 24 and the housing is rotatably mounted on a center post 26. The center post 26 is supported from a base member 28 so that the entire toy can rest with stability on a printing surface P to which it is desired to apply a printed pattern.

Figure 2:
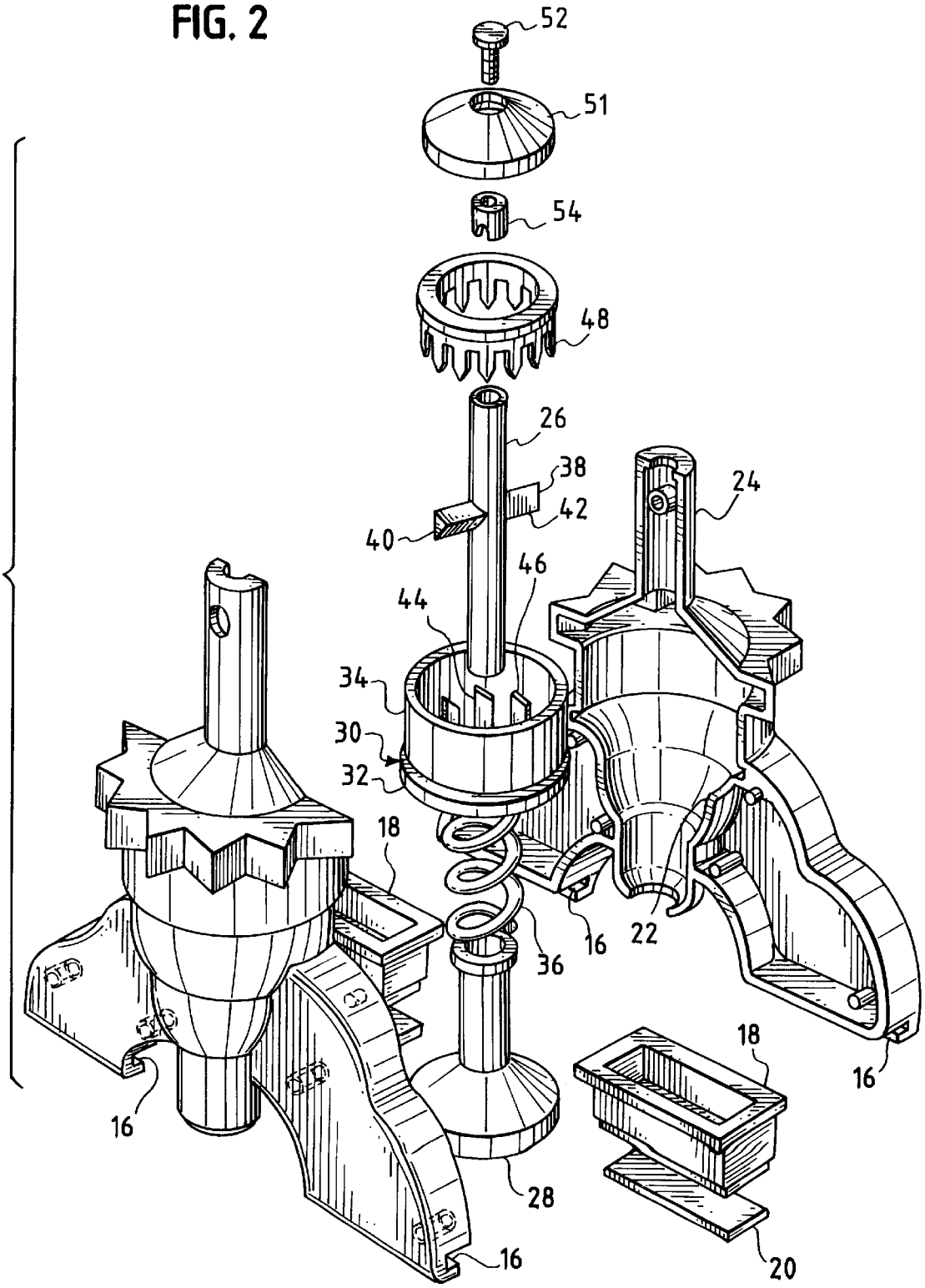
FIG. 2 is a perspective exploded view thereof.
Figure 3:
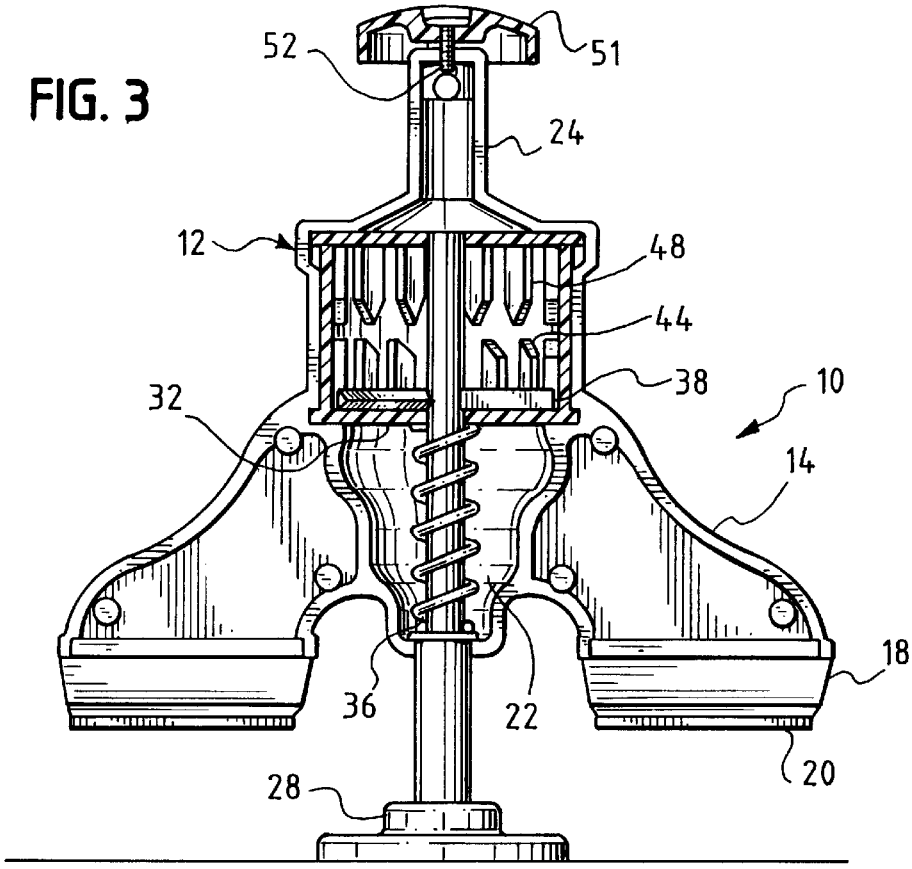
FIG. 3 is a vertical sectional view showing the toy in its neutral or inoperative position.
Figure 4:
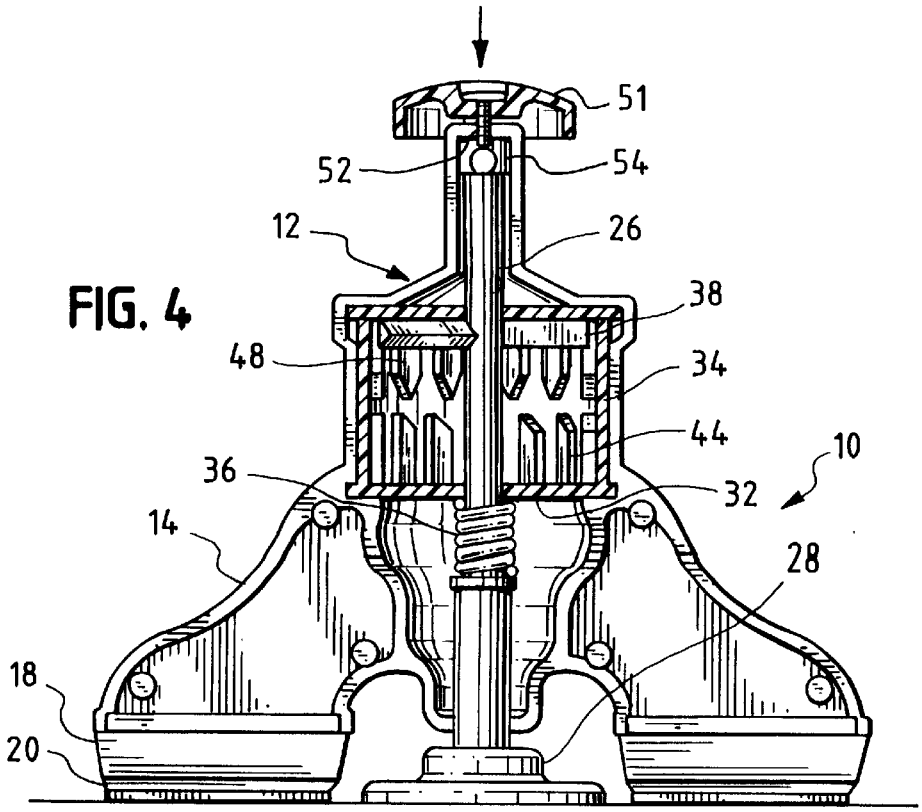
FIG. 4 is a similar view showing the toy fully depressed in operational stamping position.

As indexing drum 30 is rotatably mounted on the center post 26 and said drum is fixedly retained within the housing cavity 22 so that the housing and drum rotate as a unit. Indexing drum 30 comprises a bottom wall 32 and a cylindrical wall 34 and may be open at its top as indicated in FIGS. 2–4 of the drawings. The bottom wall 32 rests upon and is biased upwardly by a spring 36 mounted therebeneath on the center post 26. Upward biasing movement of the drum 30 is limited by indexing rod 38 which is rigidly secured to the post 26. It will be noted that the rod 38 is triangular in section and that the two arms 40 and 42 thereof are in 180° opposed relationship for reasons which will become apparent as the description proceeds.

Referring specifically to FIGS. 2 and 3–5, there is positioned around the inside of the cylindrical wall 34 a plurality of radially spaced lower camming projections 44 projecting upwardly from bottom wall 32. Camming projections 44 are formed with upwardly facing camming surfaces such as 46. At the top of the drum 30, there is positioned around the inside of the cylindrical wall 34 a plurality of indexing fingers 48 depending from a frictionally press fit ring 49. The indexing fingers 48 have angled camming surfaces 50, 50 and are like in number and spacing to the lower camming projections 44. It is important to note however, that the depending fingers 48 and lower projections 44 are vertically misaligned (see FIGS. 6–9). Also, it should be noted that the arms 40, 42 of the indexing rod 38 are sized to fit within the spaces between pairs of fingers 48 and projections 44.

An operating handle, such as knob-like handle 51, is connected to the center post 26 and closes the top of the housing 12. Handle 51 is connected to the housing 12 by a pin 52 which passes rotatably through a cap member 54 and is threadedly engaged in the top of the post 26. Thus, the entire housing 12 is free to rotate while a user of the toy holds the handle 51 stationary.

Figure 10:
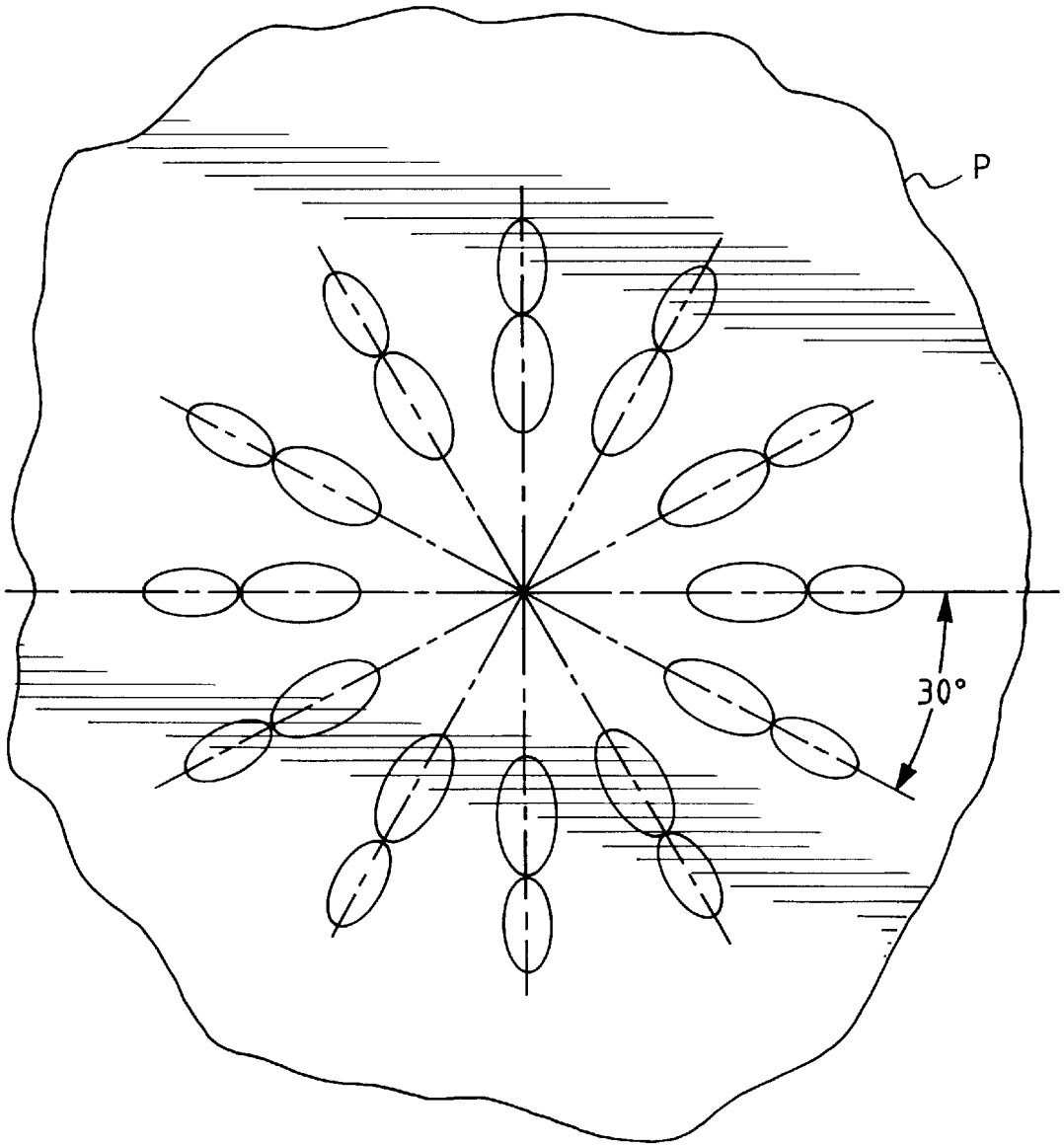
FIG. 10 is a fragmentary view of a surface illustrating a representative stamped pattern thereon.

Operation of the toy 10 may now be appreciated with reference to FIGS. 6–9. When the housing 12 is in the neutral or inoperative position, the indexing rod 38 is bearing against the bottom wall 32 of the drum 30 and positioned between a pair of lower projections 44 (see FIGS. 3 and 5). As the operator presses on the handle 51 to initiate a stamping operation, drum 30 descends and the rod 38 contacts the camming surfaces 50 of the affected pair of fingers 48 resulting in a slight rotation of the drum and housing in the direction of the arrows as the rod moves up into the space between a pair of fingers 48 (see FIG. 8). After printing on the surface P, the operator releases pressure on the handle 51 whereupon the spring 36 causes upward movement of the drum and housing. During this movement, the rod 38 bears against the camming surfaces 46 of the affected pair of lower projections 44 until the rod enters the space between the affected adjacent pair of projections and again bears on the bottom wall of the drum. As indicated by the arrows (see FIG. 9) this latter movement results in a rotation of the drum and housing through a radial angle defined by the spacing between the indexing projections. The toy has now been indexed and is ready for the next printing cycle, a pattern such as shown in FIG. 10 being made possible by such automatic indexing and use through 180°. The indexing rotation is facilitated by the opposed angled faces 40, 42 of the rod 38 cooperating with the camming surfaces 46, 50 which occupy diametrically opposed positions.

It should be understood that the toy may be fabricated by different methods, but as indicated in the illustrated embodiment, the same comprises a molded plastic structure wherein the housing 12 comprises two halves. The drum and its indexing projections and fingers may be made in one piece or comprise three separate elements (i.e., top ring, bottom wall member and cylindrical wall) press fit together as illustrated. Similarly, the illustrated preferred embodiment comprises 12 equally spaced fingers and projections creating an indexing movement of 30° although other angular arrangement are likewise possible. Furthermore the toy may be successively indexed without full depression and printing so that spacing of multiples of initial radial spacing may be achieved.

It should also be appreciated that a preferred embodiment has been described for illustrative purposed only and that changes and variations may be made by those skilled in the art without departing the spirit and scope of the invention as defined in the appended claims.

What is claimed:

1. A stamping toy comprising: a housing assembly including a center post with a support base; a cylindrical drum assembly rotatably mounted on said post; an outwardly projecting arm; printing means mounted on said arm; resilient means on the post beneath the drum and biasing said housing assembly and drum upwardly to an inoperative position with the printing means raised from the base; and indexing means within said drum adapted to rotate the printing means when the drum is depressed to bring the printing means into operative printing position on a supporting surface and then released back to the inoperative-position.

2. A stamping toy according to claim 1 where said printing means comprises a self-inking stamp pad, said pad being releasably retained on the arm.

3. A stamping pad according to claim 2 wherein the housing assembly includes a pair of said arms projecting oppositely from the drum.

4. A stamping toy according to claim 1 where said indexing means comprises a rod fixedly secured to said center post and positioned within said drum.

5. A stamping toy according 4 wherein said indexing means comprises a plurality of depending fingers radially spaced in said drum adjacent the top thereof and a plurality of projections radially spaced in said drum adjacent the bottom thereof, said fingers and projections comprising camming surfaces adapted to cooperate with said rod as the drum moves between inoperative and operative positions.

6. A stamping pad according to claim 5 wherein said rod comprises triangular shaped arms in opposed 180° relationship adapted to cooperate with diametrically opposed camming surfaces of said fingers and projections.

7. A stamping toy comprising: a center post; a drum rotatably mounted on said post, said drum including a bottom wall and a cylindrical side wall; a plurality of depending fingers spaced radially inside the side wall adjacent the top of the said drum; a plurality of lower projections spaced radially inside the side wall adjacent the bottom wall of said drum; said depending fingers and lower projections comprising opposed angled camming surfaces; a rod fixedly mounted on said center post and positioned within said drum, said rod being sized to fit within the spaces between adjacent pairs of said fingers and projections; spring means on said post beneath the drum and acting against the drum bottom wall biasing said drum upwardly to a position limited by the rod bearing against said bottom wall; a housing fixedly mounted on said drum and comprising a pair of oppositely projecting arms; and printing means carried at the ends of said housing arms; said drum and housing being moveable between an inoperative position wherein said rod bears against the drum bottom wall and an operative printing position wherein said rod rises relative to said fingers and upon release of the compressed spring means and moves back down to the bottom wall and during said movement cooperates with the camming surfaces of said fingers and projections to automatically rotate the housing, through an angle determined by the spacing between an adjacent pair of said projections.

* * * * *